US006491532B1

(12) United States Patent
Schoepf et al.

(10) Patent No.: US 6,491,532 B1
(45) Date of Patent: Dec. 10, 2002

(54) ARC SUPPRESSED ELECTRICAL CONNECTORS

(75) Inventors: Thomas J Schoepf, Rochester Hills, MI (US); George Albert Drew, Warren; Steven A Musick, Burton, both of OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/897,773

(22) Filed: Jun. 29, 2001

(51) Int. Cl.[7] ..... H01R 13/53

(52) U.S. Cl. ..... 439/181; 439/38

(58) Field of Search ..... 439/38, 181, 183

(56) References Cited

FOREIGN PATENT DOCUMENTS

JP 11-329206 * 11/1999

OTHER PUBLICATIONS

A New Connector for 42V Automotive Electrical System, K. Sakiyama, T. Ide andK. Akashi, Society of Automotive Engineers World Congress, Mar. 5, 2001.

SAE Technical Paper Series; "A New Connector for 42V Automotive Electrical System"; Akashi et al; Mar. 5–8, 2001.

* cited by examiner

*Primary Examiner*—Gary F. Paumen
*Assistant Examiner*—Ann McCamey
(74) *Attorney, Agent, or Firm*—Thomas N. Twomey

(57) ABSTRACT

Electrical arc suppression when terminals under load are connected/unconnected is provided via an applied magnetic field causing the arc path to be lengthened, with the consequences that the voltage necessary for the arc to be sustained is increased and the arc energy is decreased. In a preferred form, at least one magnet with a high permeability flux return path is placed adjacent the terminal proximity zone of initial/final touching of mating terminals. The magnetic field increases the arc length, and thereby suppresses the arc by increasing the voltage necessary to sustain the arc and decreasing the energy of the arc.

12 Claims, 4 Drawing Sheets

ARC SUPPRESSED ELECTRICAL CONNECTORS

TECHNICAL FIELD

The present invention relates to electrical connectors, and more particularly to electrical arc suppression when the electrical connectors are separated from each other under load.

BACKGROUND OF THE INVENTION

Power and signal distribution connectors mechanically and electrically connect at least two conductors at, ideally, the lowest possible power loss. Connectors are not designed to make and break an electrical circuit. Devices such as switches, relays and contactors are designed to switch current/voltage circuits. Nevertheless, during their service life, connectors can be plugged/unplugged under load many times (i.e. "hot plugged"). Very often this disconnection under load occurs when physically switching off the power in advance would be considered time-consuming and inconvenient. Also, connectors in automotive power networks are plugged and unplugged under load during diagnostic procedures, fuses are plugged at short circuit conditions, and so forth. Under some circumstances in the above situations, the connector suffers no significant damage with multiple engages/disengages. Other times, just one disconnect will damage the terminals beyond repair. In other words, under specific conditions, a long arc may be generated at engage/disengage, which may cause extensive terminal erosion. This erosion may damage the physical shape of the terminal, preventing re-engagement or proper terminal contact forces after assembly. Additionally, the electrical arc may have serious consequences for the environment or nearby personnel.

FIGS. 1A and 1B depict a pair of matable electrical connectors 10, wherein the male terminal 12 thereof has just been separated from the female terminal 14 thereof, and the tips of the terminals are presently within the terminal proximity zone Z. By "terminal proximity zone" is meant a zone length over which an electrical arc is most prone to arise when the terminals are subjected to an applied voltage (that is, when under load), which length may vary depending, for example, upon circuit load and atmospheric conditions. An electrical arc 16 leaps between the closest tips 12*t*, 14*t* of the terminals 12, 14, taking a most direct path therebetween. Because a most direct path is taken, the arc energy is maximal, resulting in potential for terminal erosion and for possible personnel injury.

Accordingly, it would be highly desirable if such arcs could be suppressed (quenched).

As shown at FIGS. 2A and 2B, it is well known that if a wire 20 is located between attracting magnets 22, 24 so as to be inside the magnetic field B, and if a current I is flowing along the wire, then a force is applied to the moving electrons by the magnets, referred to as the "Lorentz Force". The direction of the force depends upon the direction of the magnetic field B and the direction of the current I, as shown. The resulting force F applied to the wire depends upon the magnitude of both the current I and the magnetic field B, the length of the wire exposed to the magnetic field, and the relative orientation between the wire and the magnetic field, given by:

$$F=IlB \sin \theta,$$

where l is the length of wire exposed to the magnetic field B and θ is the angle between B and I, as shown by FIG. 2.

When the angle θ is ninety degrees (that is, I is perpendicular to B), sin θ equals one and the force F is a maximum. When the angle θ is zero degrees (that is, I is parallel to B) sin θ equals zero and the force F is a minimum (equal to zero).

It would be desirable if somehow the above discussed Lorentz Force could be adapted to suppress electrical arcing when connectors are connected/unconnected under load.

SUMMARY OF THE INVENTION

The present invention provides electrical arc suppression when terminals under load are connected/unconnected via an applied magnetic field causing the arc path to be lengthened, with the consequences that the voltage necessary for the arc to be sustained is increased and the arc energy is decreased.

An electrical arc may be generated between terminals (including electrodes, contacts, etc.) when both the voltage and the current exceed certain minimum values. These minimum values are determined by the electrode material (e.g. silver 12V/0.4A, and carbon 20V/0.01A). In this regard, a magnetic field electrical arc suppression assembly according to the present invention includes at least one magnet placed adjacent the location (terminal proximity zone) of initial/final touching of mating connector terminals. The magnetic field produced the at least one magnet pervades the space occupied by the air gap between the terminals (the terminal proximity zone) such that as the terminals are brought into contact or separated from contact and the circuit is live, the tendency of an electrical arc to arise and be sustained is suppressed (quenched) by the magnetic field applying a force on the moving electrons as the arc commences. This force causes the electrons to take a curved (or otherwise longer) path across the air gap rather than take a straight-line path. Because a curved path is longer than a direct (straight line) path, a higher arc voltage is required to sustain the arc and the arc energy is diminished, thus suppressing (quenching) the arc, and thus greatly reducing the energy of the arc.

The at least one magnet may, for example, be in the form of a single magnet or a pair of diametrically opposed, attracting magnets. The at least one magnet may be of the permanent type, or may be of the electromagnet type. A magnetic circuit is provided via a yoke, as for example composed of a ferromagnetic material, to minimize reluctance of the magnetic circuit and thereby optimize the magnetic field conditions in the air gap of the terminal proximity zone during engage/disengage of the terminals.

The arc suppression (quenching) effect of the magnetic field according to the present invention is not limited by choice of the location of the at least one magnet. For example, it is possible to have the at least one magnet either integral with, or unconnected with, the connector. In other words, the at least one magnet may be integrated into the structure of the connector, be attached to a stationary part of the connector (e.g., fuse box), or be connected to a movable part of the connector or another component (e.g., a wiring harness) or some combination thereof. It is important that the magnetic field in the terminal proximity zone be oriented as close as possible to perpendicular in relation to the direction of the electrical current. Also, since the arc suppression performance of the magnetic field is dependent upon the strength of the magnetic field, a stronger magnet gives a better arc suppression (quenching) performance.

The present invention includes all possible methods of packaging the at least one magnet, as for example by molding, spraying, assembling, etc. Further, where the electromagnet type is used, the current therefore may be from a circuit carrying current through the connectors, or may be from a circuit external to the connectors. Additionally, the aforedescribed magnetic field suppression of connector separation arcing may also be applied at component terminals used to connect relays, fuses, electronic modules, motors, resistors, capacitors, inductances, lamps, etc.

Accordingly, it is an object of the present invention to provide suppression of electrical arcing between separating/connecting terminals under load via an applied magnetic field in the air gap between the terminals.

This and additional objects, features and advantages of the present invention will become clearer from the following specification of a preferred embodiment.

DESCRIPTION OF THE PREFERRED EMBODIMENT

Figure 1A:
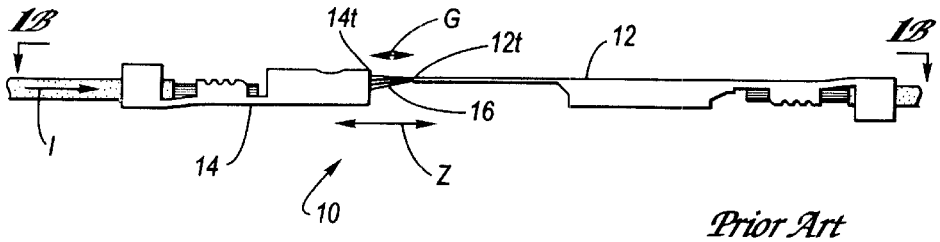
Prior Art Fig. 1A
FIG. 1A is a side view of a prior art pair of electrical connectors, shown being separated under load.
Figure 1B:
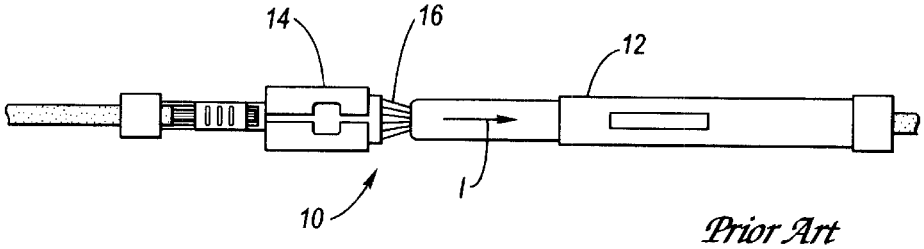
Prior Art Fig. 1B
FIG. 1B is a bottom plan view of the pair of prior art electrical connectors, seen along line 1B—1B of FIG. 1A.
Figure 2A:
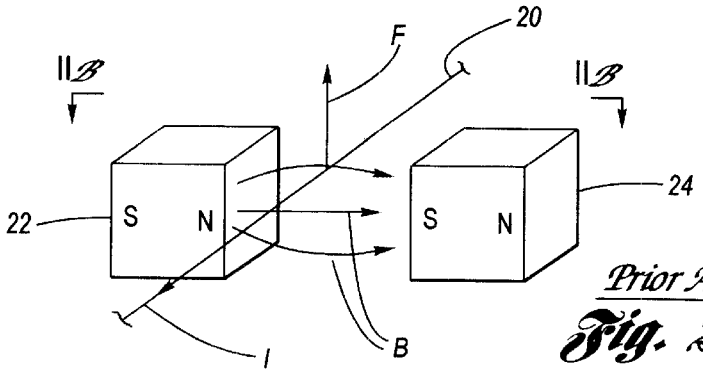
Prior Art Fig. 2A
FIG. 2A is a perspective view of a current carrying wire exposed to a magnetic field being subjected to a force by the magnetic field.
Figure 2B:
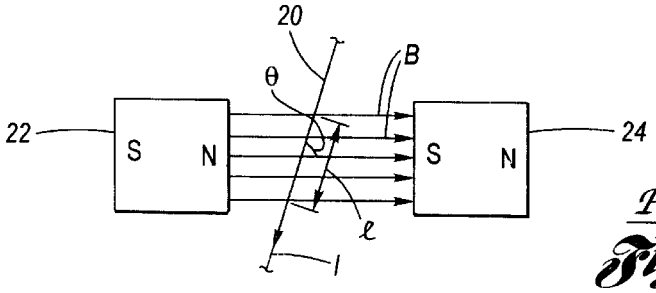
Prior Art Fig. 2B
FIG. 2B is a top plan view, seen along line 2B—2B of FIG. 2A.
Figure 3A:
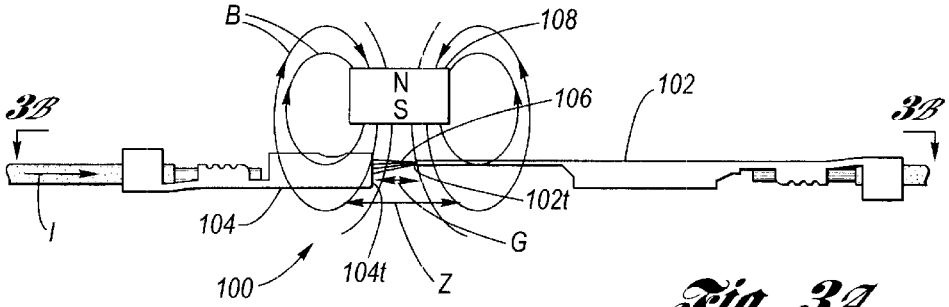
FIG. 3A is a side view of a pair of electrical connectors equipped with magnetic field electrical arc suppression according to the present invention, shown being separated under load.
Figure 3B:
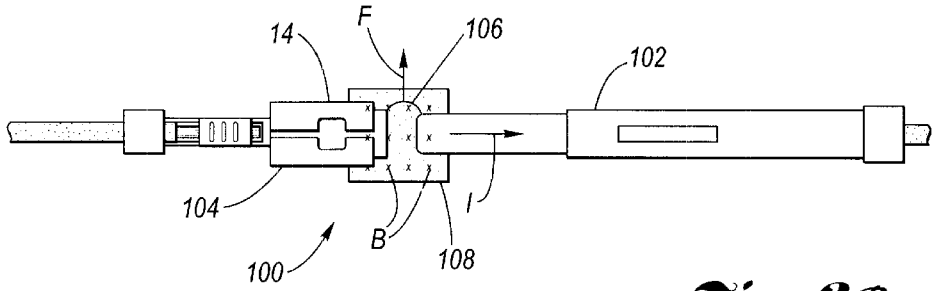
FIG. 3B is a bottom plan view of the pair of electrical connectors, seen along line 3B—3B of FIG. 3A.
Figure 4:
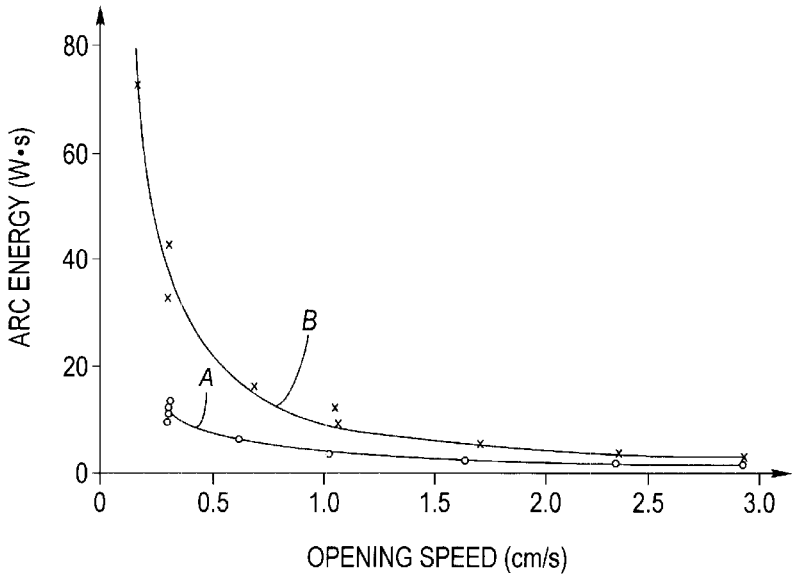
FIG. 4 is a graphical depiction of electrical arc energy as a function of separation speed for a pair of terminals with and without magnetic field electrical arc suppression.
Figure 5:
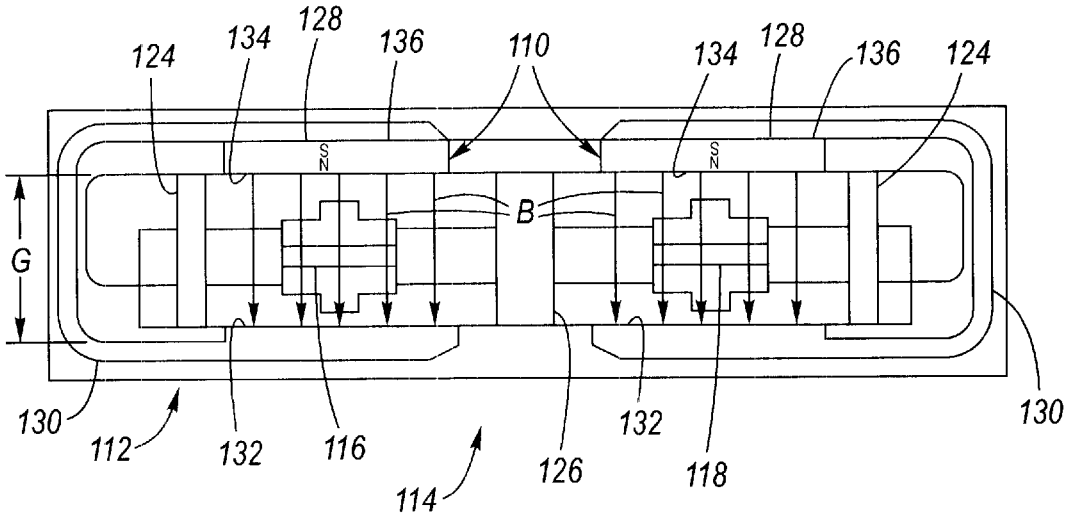
FIG. 5 is a front end view of an electrical connector equipped with a magnetic field electrical arc suppression assembly according to the present invention.
Figure 6:
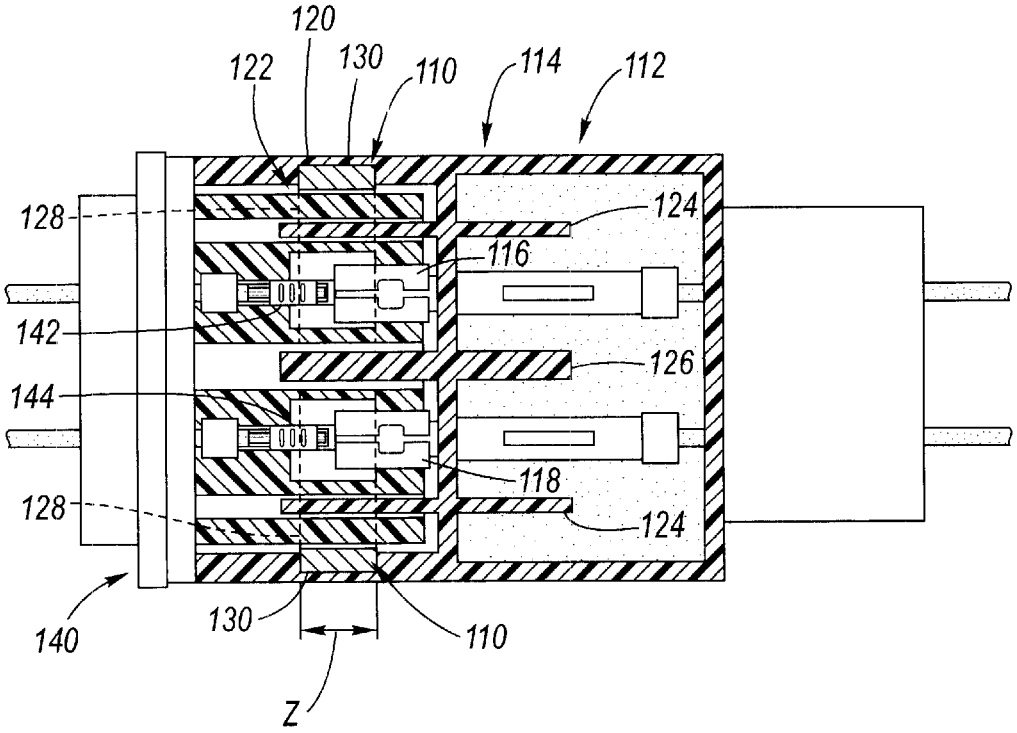
FIG. 6 is a partly sectional top view of a mated pair of connectors, wherein one of the connectors is equipped with the magnetic field electrical arc suppression assembly as depicted at FIG. 5.
Figure 7:
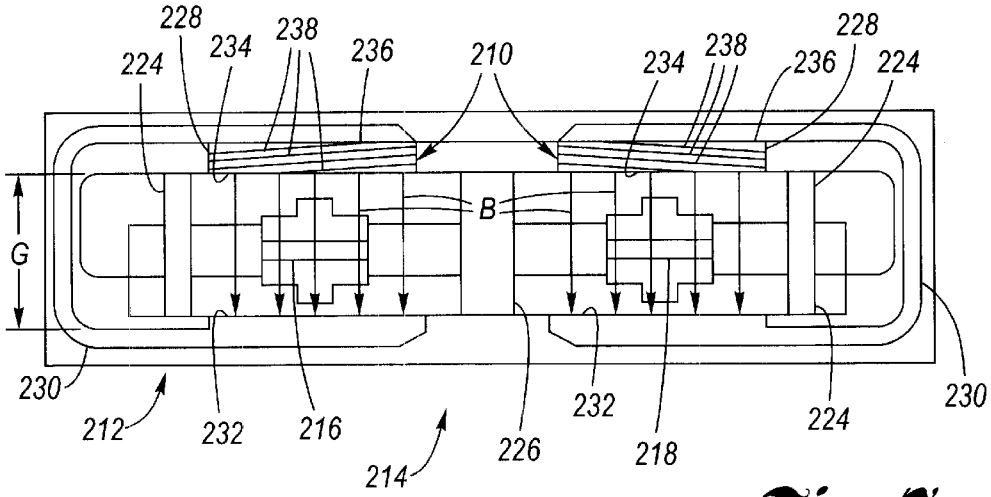
FIG. 7 is a front end view of an electrical connector equipped with an alternative magnetic field electrical arc suppression assembly according to the present invention.
Figure 8:
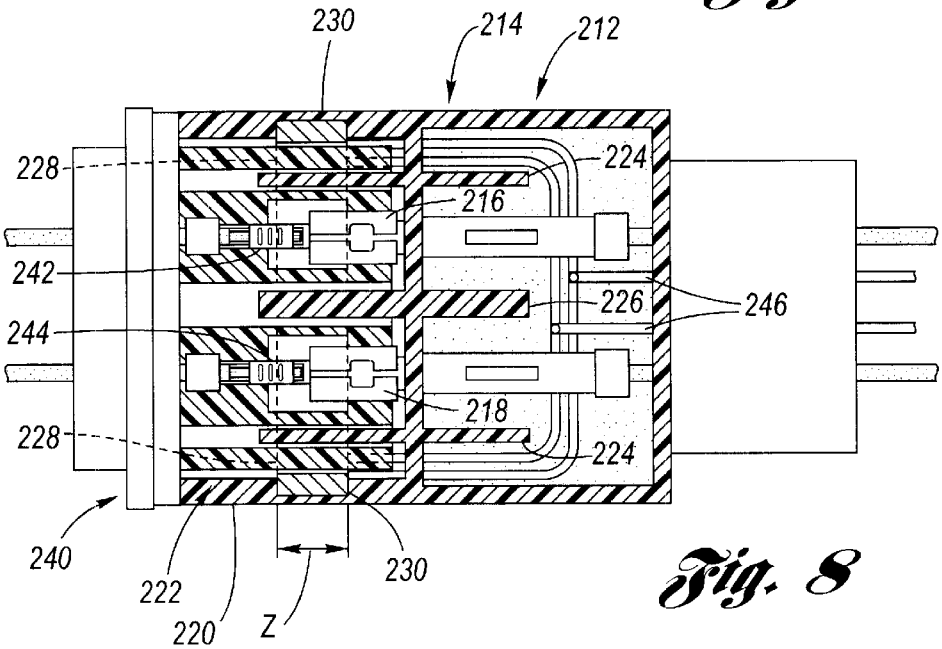
FIG. 8 is a partly sectional top view of a mated pair of connectors, wherein one of the connectors is equipped with the alternative magnetic field electrical arc suppression assembly as depicted at FIG. 7.
Figure 9:
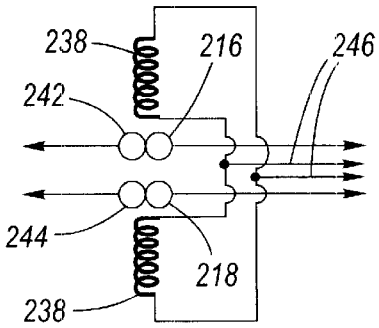
FIG. 9 is a circuit diagram for the pair of connectors depicted at FIGS. 7 and 8.

Referring now to the Drawing, FIGS. 3 through 9 depict the present invention, wherein FIGS. 3A through 4 depict the operative principles, FIGS. 5 and 6 depict a preferred embodiment of the present invention, and FIGS. 7 through 9 depict an alternative preferred embodiment of the present invention.

At FIGS. 3A and 3B, a pair of electrical connectors 100 are shown in the form of single terminal mating male and female connectors 102, 104. The mutually closest tips 102*t*, 104*t* of the terminals 102, 104 are separated by an air gap G which is within the terminal proximity zone Z, the length of the zone being that which is most prone to involve electrical arcing and may vary depending, for example, upon circuit load and atmospheric conditions. An electrical arc 106 leaps between the terminals 102, 104. However, because a magnet 108 provides a magnetic field B in the terminal proximity zone Z, as the electrons span the air gap G between the tips, the magnetic field subjects them to a force F which is perpendicular to their direction of movement. Accordingly, the electrons cannot take a most direct path (straight line) between the tips 102*t*, 104*t*, but rather must take a curved path (see FIG. 3B). Because a curved path is longer than a direct (straight line) path, a higher arc voltage is required to sustain the arc and the arc energy is diminished, thus suppressing (quenching) the arc 106.

FIG. 4 is a graph of arc energy versus opening (separation) speed for two pairs of terminals, one pair of terminals, identified by Curve A has magnetic field electrical arc suppression, while the other pair of terminals, identified by Curve B, does not. Curve A clearly indicates electrical arc suppression as compared to Curve B, wherein the magnetic field has a value of 0.215T in the terminal proximity zone. The pair of terminals of Curve A benefits from the magnetic field lengthening the arc and therefore increasing the necessary voltage to sustain the arc. This, in turn, shortens both arc duration and arc energy which reduces erosion of the terminals of Curve A.

FIGS. 5 and 6 depict a preferred example of a magnetic field electrical arc suppression assembly 110 integrated into an electrical connector 112, collectively providing an arc suppressed connector 114 .

FIG. 5 shows merely by way of example two male terminals 116, 118 located in the electrical connector 112, which is female as defined by a shroud 120. The shroud 120, in turn, defines an interior space 122. The terminal proximity zone Z (see FIG. 6) is located generally at a mid-section of the interior space 122. The terminals 116, 118 are isolated by outer arc walls 124 and an inner arc wall 126.

The magnetic field arc suppression assembly 110 has a counterpart at each terminal 116, 118, each counterpart including a magnet 128 and a yoke 130. The magnet 128 is of the permanent type and is located by the shroud 120 so as to laterally overlie the respective terminal across the terminal proximity zone Z. The yoke 130 is composed of a high permeability (ferromagnetic) material, as for example iron, and includes a pole piece 132 which is positioned via the shroud diametrically opposite the magnet 128. The facing pole 134 of the magnet 128 provides a magnetic field B across an air gap G to the pole piece 132. The yoke 130 provides a U-shaped return flux path to the opposing pole 136 of the magnet so that a majority of reluctance the magnetic circuit is located at the terminal proximity zone.

FIG. 6 depicts a male mating connector 140 having female terminals 142, 144, shown mated with the arc suppressed connector 114 and its respective terminals 116, 118. In operation, should the mating connector 140 be separated from, or joined to, the arc suppressed connector 114 and the circuit connected with the terminals have a voltage applied across the terminals, an arc would tend to form across the terminal proximity zone, except that the magnetic field will suppress (quench) the arc because the path taken by the electrons between the terminals must be curved, as opposed to straight, as detailed and explained hereinabove.

It will be understood that two permanent magnets could alternatively be utilized, wherein the second magnet is located where the pole piece is shown in FIG. 5 (that is, it replaces the pole piece), and wherein the yoke would be U-shaped so as to provide a return flux path between the opposing poles of each of the magnets. Further, the magnetic circuit can be designed to suit size, weight, cost and other criteria, in which, for example, a single magnet may provide a magnetic field for a number of terminal proximity zones.

Turning attention now to FIGS. 7 though 9, an alternative example of a magnetic field electrical arc suppression assembly 210 integrated into an electrical connector 212, collectively providing an arc suppressed connector 214.

FIG. 7 shows merely by way of example two male terminals 216, 218 located in the electrical connector 212, which is female as defined by a shroud 220. The shroud 220, in turn, defines an interior space 222. The terminal proximity zone (see FIG. 8) is located generally at a mid-section of the interior space 222. The terminals 216, 218 are isolated by outer arc walls 224 and an inner arc wall 226.

The magnetic field arc suppression assembly 210 has a counterpart at each terminal 216, 218, each counterpart including a magnet 228 and a yoke 230. The magnet 228 is of the electromagnet type, which may advantageously include a ferromagnetic core, and is positioned via the shroud 220 so as to laterally overlie the respective terminal across the terminal proximity zone Z. The yoke 230 is composed of a high permeability (ferromagnetic) material, as for example iron, and includes a pole piece 232 which is located in the shroud diametrically opposite the magnet 228. The facing pole 234 of the magnet 228 provides a magnetic field B across an air gap G to the pole piece 232. The yoke 230 provides a U-shaped return flux path to the opposing pole 236 of the magnet so that a majority of reluctance the magnetic circuit is located at the terminal proximity zone. Current to energize the windings 238 of each of the magnets 228 is provided by a separate circuit 246 (see the wiring diagram of FIG. 9).

FIG. 8 depicts a male mating connector 240 having female terminals 242, 244, shown mated with the arc suppressed connector 214 and its respective terminals 216, 218.

In operation, should the mating connector 240 be separated from, or joined to, the arc suppressed connector 214 and the circuit connected with the terminals have a voltage applied across the terminals, an arc would tend to form across the terminal proximity zone, except that the magnetic field will suppress (quench) the arc because the path taken by the electrons between the terminals must be curved, as opposed to straight, as detailed and explained hereinabove.

Figure 10:
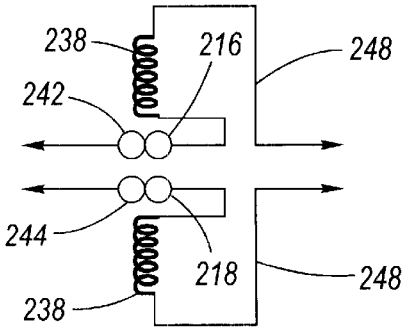
FIG. 10 is an alternative circuit diagram, wherein the current to power the magnets is provided by the terminal current, itself.

The current to power the magnet 228 may alternatively be provided by the terminal circuit 248, itself, as depicted by the wiring diagram of FIG. 10. It is believed in this regard, that when the terminals separate, the magnetic field collapse is momentarily postponed by electrical arcing. Accordingly, the magnetic field will serve to suppress (quench) the arc before and during its collapse. On the other hand, it is believed that when the terminals approach contact, in order for an arc to be present, a current must be flowing in the windings, whereupon the magnetic field will serve to quench the arc. Of course, in either case, any electromotive force due to inductance of the windings should be considered in designing the magnets 228.

It will be understood that two electromagnets could alternatively be utilized, wherein the second magnet is located where the pole piece is shown in FIG. 7 (that is, it replaces the pole piece), and wherein the yoke would be U-shaped so as to provide a return flux path between the opposing poles of each of the magnets. Further, the magnetic circuit can be designed to suit size, weight, cost and other criteria, in which, for example a single magnet may provide a magnetic field for a number of terminal proximity zones.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. An assembly for suppressing an electrical arc between closely separated terminals, comprising:

at least one terminal having an adjoining terminal proximity zone;

at least one magnet; and a yoke connected with said at least one magnet;

wherein said at least one magnet provides a predetermined magnetic field across said terminal proximity zone; and wherein said yoke provides a high permeability return flux path for the magnetic field.

2. The assembly of claim 1, wherein said at least one terminal defines a current direction, and wherein said magnetic field is oriented substantially perpendicular in relation to said current direction.

3. The assembly of claim 2, wherein said at least one magnet comprises at least one permanent magnet.

4. The assembly of claim 3, wherein said at least one magnet is a permanent magnet having a direct facing pole and an opposite facing pole;

and wherein said yoke comprises:

a pole piece disposed across said terminal proximity zone in diametrically opposed relation to said direct facing pole of said permanent magnet; and a high permeability return flux path between said pole piece and said opposite facing pole.

5. The assembly of claim 2, wherein said at least one magnet comprises at least one electromagnet.

6. The assembly of claim 5, wherein said at least one magnet is an electromagnet having a direct facing pole and an opposite facing pole; and wherein said yoke comprises:

a pole piece disposed across said terminal proximity zone in diametrically opposed relation to said direct facing pole of said permanent magnet; and a high permeability return flux path between said pole piece and said opposite facing pole.

7. An electrical connector, comprising:

a connector body;

at least one terminal located in said connector body, said at least one terminal having an adjoining terminal proximity zone;

at least one magnet connected with said connector body; and a yoke connected with said terminal body;

wherein said at least one magnet provides a predetermined magnetic field across said terminal proximity zone; and wherein said yoke provides a high permeability return flux path for the magnetic field.

8. The electrical connector of claim 7, wherein said at least one terminal defines a current direction, and wherein said magnetic field is oriented substantially perpendicular in relation to said current direction.

9. The assembly of claim 8, wherein said at least one magnet comprises at least one permanent magnet.

10. The assembly of claim 9, wherein said at least one magnet is a permanent magnet having a direct facing pole and an opposite facing pole;

and wherein said yoke comprises:

a pole piece disposed across said terminal proximity zone in diametrically opposed relation to said direct facing pole of said permanent magnet; and a high permeability return flux path between said pole piece and said opposite facing pole.

11. The assembly of claim 8, wherein said at least one magnet comprises at least one electromagnet.

12. The assembly of claim 11, wherein said at least one magnet is an electromagnet having a direct facing pole and an opposite facing pole; and wherein said yoke comprises:

a pole piece disposed across said terminal proximity zone in diametrically opposed relation to said direct facing pole of said permanent magnet; and a high permeability return flux path between said pole piece and said opposite facing pole.

* * * * *